US012473064B2

(12) United States Patent
Black et al.

(10) Patent No.: US 12,473,064 B2
(45) Date of Patent: Nov. 18, 2025

(54) AUTOMATIC LOCKING SAIL TRACK CAR SYSTEMS AND APPARATUS

(71) Applicant: RIGGING PROJECTS LTD, Southhampton (GB)

(72) Inventors: Nicholas Black, Suffolk (GB); Antoine Delaperriere, Paterna (ES)

(73) Assignee: Rigging Projects Ltd, Southhampton (GB)

( * ) Notice: Subject to any disclaimer, the term of this patent is extended or adjusted under 35 U.S.C. 154(b) by 452 days.

(21) Appl. No.: 18/246,109

(22) PCT Filed: Sep. 22, 2021

(86) PCT No.: PCT/GB2021/052460

§ 371 (c)(1),
(2) Date: Mar. 21, 2023

(87) PCT Pub. No.: WO2022/064193

PCT Pub. Date: Mar. 31, 2022

(65) Prior Publication Data

US 2023/0356821 A1 Nov. 9, 2023

(30) Foreign Application Priority Data

Sep. 23, 2020 (GB) ..... 2015027

(51) Int. Cl.
*B63H 9/10* (2006.01)
*B63H 9/08* (2006.01)

(52) U.S. Cl.
CPC ..... *B63H 9/1021* (2013.01); *B63H 2009/086* (2013.01)

(58) Field of Classification Search
CPC ... B63H 9/08; B63H 9/1021; B63H 2009/086
(Continued)

(56) References Cited

U.S. PATENT DOCUMENTS 3,938,460 A 2/1976 Wales et al.
2011/0283928 A1 11/2011 Hall et al.

FOREIGN PATENT DOCUMENTS

EP 3069986 A1 * 9/2016 ..... B63H 9/08
FR 2978952 A1 2/2013

OTHER PUBLICATIONS

International Search Report and Written Opinion of International Application No. PCT/GB2021/052460, mail date Jan. 18, 2022, 13 pages.

(Continued)

*Primary Examiner* — Timothy D Collins
(74) *Attorney, Agent, or Firm* — Grossman, Tucker, Perreault & Pfleger, PLLC; Donald J. Perreault

(57) ABSTRACT

An apparatus (100) for actuating a locking mechanism (12) of a locking sail track car (10) comprises a latch formation (116) disposed in a fixed position with respect to the track (14), a control surface (112) spaced from the latch formation (116) in a hoisting direction, and an actuator assembly (120) for attachment to the car (10). The actuator assembly (120) comprises an actuator (124) for operating a control member (24) of the car locking mechanism, and a latch element (158) connected to the actuator (124) and moveable between a first detent position in which the latch element (158) is not engageable with the latch formation (116) and a second detent position. The latch element (158) is arranged to cooperate with the control surface (112) upon movement of the actuator assembly (120) in the hoisting direction to set the latch element (158) into the second detent position, and is engageable with the latch formation (116) upon subsequent movement of the actuator assembly (120) in a loading direction with the latch element (158) in the second detent position. Engagement of the latch element (158) with the latch formation (116) fixes the actuator (124) in position with respect to the track (14) for operating the control
(Continued)

member (24) of the car locking mechanism (12) upon subsequent movement of the car (10) in the loading direction, and urges the latch element (158) out of the second detent position and towards the first detent position such that subsequent movement of the actuator assembly (120) in the hoisting direction to disengage the latch element (158) from the latch formation (116) sets the latch element (158) back into the first detent position.

20 Claims, 10 Drawing Sheets

(58) Field of Classification Search
USPC ..... 114/102.1
See application file for complete search history.

(56) References Cited

OTHER PUBLICATIONS

Search Report under Section 17(5) of United Kingdom Application No. GB2015027.2, mail date Feb. 4, 2021, 3 pages.

* cited by examiner

AUTOMATIC LOCKING SAIL TRACK CAR SYSTEMS AND APPARATUS

FIELD OF THE INVENTION

The present invention relates to securing a load in a fixed position with respect to a structure, particularly in marine applications where the load is typically a sail and the structure is a mast. In particular, the invention relates to apparatus for actuating a locking mechanism of a locking sail track car to provide automatic locking functionality when hoisting a sail, and to a locking sail track system.

BACKGROUND TO THE INVENTION

A sail of a marine vessel is typically connected to a mast by an arrangement which allows the sail to be hoisted or lowered in use whilst keeping the sail connected to the mast. One approach, which is widely used for mainsails, is to provide a channel or track which extends along the mast. Part of the sail, or part of a device connected to the sail, is arranged to engage with the track or channel, and to move up and down the mast as the sail is hoisted or lowered. In some examples, a flexible line (known as a bolt rope) is sewn into the edge of the sail to provide a thickened bead which extends along an edge of the sail and which is threaded into a channel in the mast such that the sail can slide up and down the mast. In other examples, typically used in racing applications where sail hoisting speed is of greater importance, one or more devices, known as cars (also known as sliders, sail track cars or mainsail cars), are attached to an edge of the sail. The cars are arranged to slide up and down the mast whilst engaged with a track, typically a T-track, fitted to the mast. Several cars may be spaced apart along the edge of the sail. For example, where the sail is provided with reinforcing battens, a car (which may then be known as a batten car) may be connected to each batten.

In some applications, at least one car is arranged to lock in position on the track, so as to fix the position of the sail with respect to the mast. The or each car may be arranged to lock at more than one position along the mast track, for example to allow the sail to be reefed. In this way, tension in a line (halyard) used to hoist the sail can be released once the car is locked, so that the halyard does not stretch and sail shape is maintained. In such cases, the car includes a locking mechanism, which typically comprises at least one pawl or latch for engagement with a feature of the track, such as a recessed seat or slot. A locking car may be attached to a plate (headboard) which reinforces a top corner portion (head) of the sail (in which case the car may be referred to as a headboard car).

Some car locking mechanisms are arranged to engage with the track when actuated manually, for example by pulling a trip line which extends from the car to an accessible position at the foot of the mast. When the sail is hoisted, a car positioned on the mast is not typically accessible by crew and so manually actuating the locking mechanism may be unreliable, since a user may not be able to determine whether the mechanism has locked successfully. Accordingly, some car locking mechanisms are arranged to engage automatically with the track when the car is hoisted to a predetermined position along the track and subsequently lowered. To release the locking mechanism, the sail is hoisted again, past the predetermined position, and the pawl or latch is released, either automatically, or by movement of an actuator, allowing the sail to be lowered.

US 2011/0283928 A1 discloses a latch mechanism for a sail car which engages and disengages with a sail track as the sail is hoisted or lowered, to provide a "hoist to lock, hoist to unlock" method of operation.

Latches or pawls of locking car mechanisms may be subject to considerable force from sail load in use, and so these components may be relatively large and/or heavy. In known locking cars, such load bearing components may be required to pivot through a relatively large angle in order to lock and unlock the locking mechanism. Accordingly, such locking cars, and/or parts of a corresponding mast track, are sized to allow pivoting of these components, and so may be undesirably bulky.

Modifying or upgrading an existing sail track system to include an automatic locking car may be inconvenient and costly, since it is usually necessary to replace the mast track and may involve cutting additional openings in the mast to install parts of the track.

It is against this background that the present invention has been devised.

SUMMARY OF THE INVENTION

From a first aspect, the present invention provides an apparatus for actuating a locking mechanism of a locking sail track car, the car being slidable on a track, and the locking mechanism comprising a control member operable to switch the locking mechanism between an unlocked configuration in which the device is free to slide on the track and a locked configuration in which the locking mechanism engages with the track to block movement of the car in a loading direction.

The apparatus comprises a latch formation disposed in a fixed position with respect to the track, a control surface spaced from the latch formation in a hoisting direction, opposite to the loading direction, and an actuator assembly for attachment to the car.

The actuator assembly comprises an actuator for operating the control member of the car locking mechanism, and a latch element connected to the actuator and moveable between a first detent position in which the latch element is not engageable with the latch formation and a second detent position. The latch element is arranged to cooperate with the control surface upon movement of the actuator assembly in the hoisting direction to set the latch element into the second detent position. The latch element is engageable with the latch formation upon subsequent movement of the actuator assembly in the loading direction with the latch element in the second detent position, whereby engagement of the latch element with the latch formation fixes the actuator in position with respect to the track for operating the control member of the car locking mechanism upon subsequent movement of the car in the loading direction, and urges the latch element out of the second detent position and towards the first detent position such that subsequent movement of the actuator assembly in the hoisting direction to disengage the latch element from the latch formation sets the latch element into the first detent position.

With this arrangement, an existing manually-operated locking sail track system, in which the locking mechanism of the car is operated by a trip line connected to the control member, can be converted to an automatically-locking system with hoist-to-lock and hoist-to-unlock functionality. In particular, the apparatus may be retro-fitted without the need to replace the existing track car or overhaul the track.

Furthermore, because the apparatus is configured to actuate the locking mechanism of the car, the load of the sail in use is borne by the locking mechanism of the car and not by the actuator assembly of the apparatus. Accordingly, the actuator assembly, and in particular the latch element, need not be designed to bear the weight of and/or load of the sail, which means that the apparatus is lighter, more compact, simpler, less costly and more reliable than is typically the case for known automatic track cars.

The latch element may be mounted to the actuator at a pivot, in which case the movement of the latch element between the first detent position and the second detent position comprises turning of the latch element about the pivot.

A biasing means may be provided to urge the latch element towards the first detent position upon disengagement of the latch element from the latch formation. Cooperation of the latch element with the control surface during movement of the actuator assembly in the hoisting direction may move the latch element from the first detent position beyond the second detent position to a trailing position, and upon subsequent movement of the actuator assembly in the loading direction the biasing means may urge the latch element from the trailing position into the second detent position. In such cases, with the latch element in the trailing position, the latch element can move beyond the control surface during movement of the actuator assembly in the hoisting direction.

Similarly, when the latch element is in the first detent position, the latch element may be cooperable with the latch formation to move the latch element into a leading position, the leading position being further from the second detent position than the first detent position. With the latch element in the leading position, the latch element can move beyond the latch formation during movement of the actuator assembly in the load direction.

A recess may be disposed between the control surface and the latch formation for accommodating an end part of the latch element when the latch element is in one of the first detent position and the second detent position.

The apparatus may comprise a detent mechanism having a follower arranged to apply a resistance force to the latch element to resist movement between the first detent position and the second detent position until the resistance force is overcome. The follower may, for example, comprise a ball plunger. The detent mechanism may comprise first and second detent tracks for engagement with the follower, in which case the first and second detent positions may correspond to the position of the latch element when the follower is disposed at adjacent ends of the first and second tracks respectively. When the latch element is mounted pivotally, the detent tracks may be arcuate grooves in the latch element.

The latch element may comprise a rider arranged to bear on the control surface when the latch element cooperates with the control surface. In one example, the rider is a wheel. A pair of latch elements may be provided, with the wheel disposed therebetween. The control surface may be a ramp.

The rider may be arranged to guard against engagement of the latch element with the track, to avoid undesired actuation or jamming of the apparatus if the car is over-hoisted. For example, the latch formation may comprise a slot or recess for receiving at least a part of the rider so as to allow the latch element to engage with the latch formation when the latch element is in the second detent position. Seats provided in the track, for engagement with pawls of the car locking mechanism, lack such slots or recesses so that the rider causes the latch element to pass over the track seats without locking.

The latch formation may comprise a step, and the latch element may comprise a notch arranged to engage with the step upon movement of the actuator assembly in the load direction when the latch element is in the second detent position, and to pass over the step upon movement of the actuator assembly in the load direction when the latch element is in the first detent position.

A housing may be provided for the actuator assembly. The housing may be attachable to the car. At least one guide may be included, for example in the housing when provided, to constrain the actuator for linear movement parallel to the track.

To allow manual release of the locking mechanism, the actuator may comprise an attachment point for attachment of a manual control line.

The apparatus may comprise a track insert including the control surface and the latch formation. The track insert is preferably installable in or adjacent to the track on which the car is slidable. Alternatively, the control surface and/or the latch formation may be part of the track.

From a second aspect, the invention resides in a sail track system, comprising a track for attachment to a support structure, a locking sail track car that is slidable on the track, the car having a locking mechanism comprising a control member operable to switch the locking mechanism between an unlocked configuration in which the device is free to slide on the track and a locked configuration in which the locking mechanism engages with the track to block movement of the car in a loading direction, and an apparatus according to the first aspect of the invention. The latch formation and the control surface are preferably disposed in line with the track and the actuator assembly is preferably attached to the car with the actuator arranged to operate the control member of the locking mechanism. The track may comprise at least one of the latch formation and the control surface.

A compression spring may be disposed between the actuator and the control member, to allow the car to move sufficiently relative to the actuator arrangement while the latch element is engaged with the latch formation for engagement of the locking mechanism of the car with the track.

Preferred and/or optional features of each aspect and embodiment of the invention may also be used, alone or in appropriate combination, in the other aspects and embodiments also.

BRIEF DESCRIPTION OF THE DRAWINGS

Embodiments of the present invention will now be described, by way of example only, with reference to the accompanying drawings, in which like reference numbers are used for like features and in which.

DESCRIPTION OF THE PREFERRED EMBODIMENTS

The present invention provides an apparatus for actuating a locking mechanism of a locking device, such as a sail track car, where the device is moveable in opposite first and second directions with respect to a supporting structure, such as a mast, and the locking mechanism is switchable between a locked configuration in which movement of the device in the second direction is limited, and an unlocked configuration in which the device is free to move with respect to the supporting structure.

In this description, the apparatus is described in use mounted to a mast. Accordingly, the terms "upwardly", "upper" and related terms refer to a direction away from gravity in use (e.g. towards the top in FIG. 1). The terms "downwardly", "lower" and related terms refer to an opposite direction (e.g. towards the bottom in FIG. 1). It will be appreciated however, that the apparatus may be used in substantially any orientation.

FIGS. 1 to 10 show an apparatus 100 according to an embodiment of the invention.

Figure 1A:
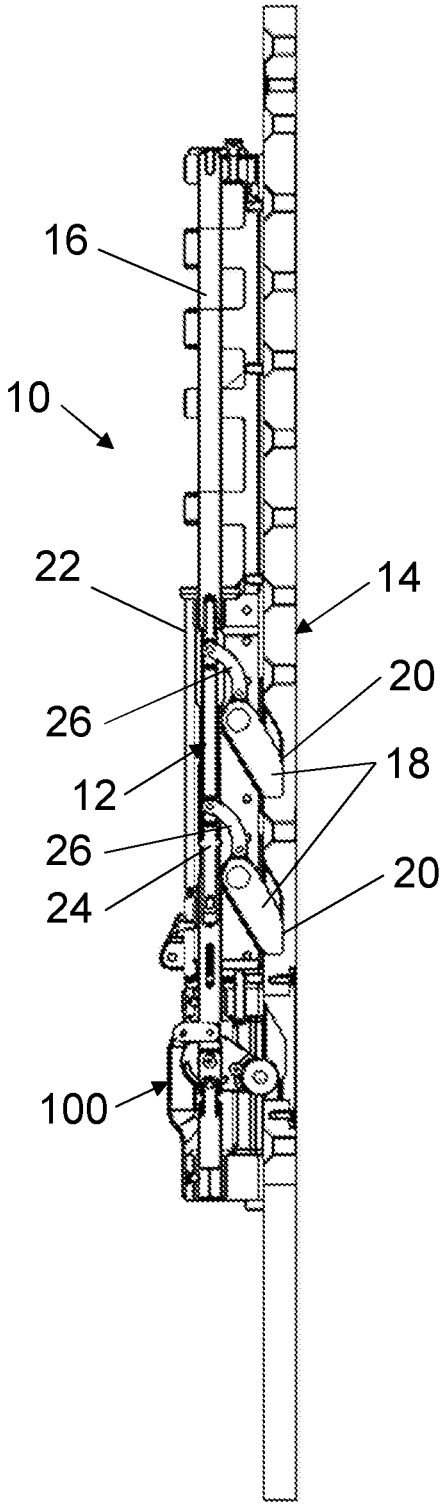
FIG. 1A is a cross-sectional view of apparatus according to an embodiment of the invention, together with a locking device and a track with which the apparatus may be used, showing the locking device in a locked configuration.
Figure 1B:
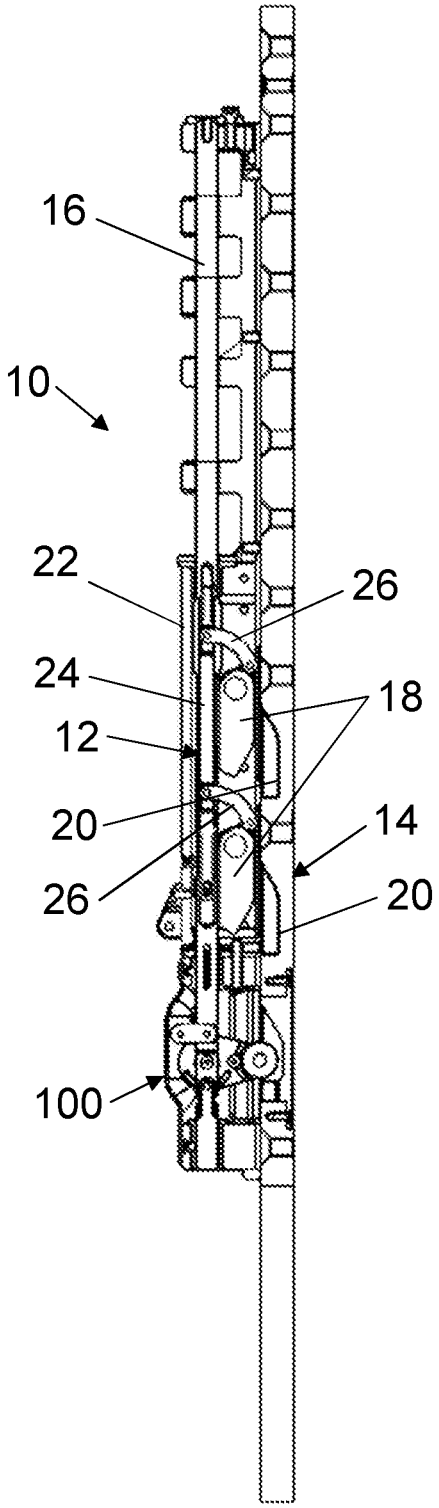
FIG. 1B is a cross-sectional view of the apparatus and locking device of FIG. 1A, showing the locking device in an unlocked configuration.

In this embodiment, the apparatus 100 is arranged to be used with a locking headboard car 10 for a sailing vessel. The apparatus 100 is arranged to actuate a locking mechanism 12 of the car 10, as described further below. As can be seen in FIGS. 1A and 1B, the car 10 is arranged to move on a supporting structure in the form of a track 14 fitted to a mast (not shown). In this embodiment the track 14 is a T-track (although other track profiles may be used in other embodiments), and in particular is a high-load or heavy duty track section for supporting the load of the car 10. The car 10 comprises a connecting portion 16 for securing a headboard of a sail (not shown) to the car 10, such that the car 10 may be hoisted and lowered with the sail. Accordingly, the car 10 is arranged to slide on the track 14 in a first, upward or hoisting direction (e.g. as the sail is hoisted) and in a second, downward or loading direction (e.g. as the sail is lowered). The car 10 is arranged to be locked in position on the track 14 in order to fix a position of the sail with respect to the mast.

Figure 2:
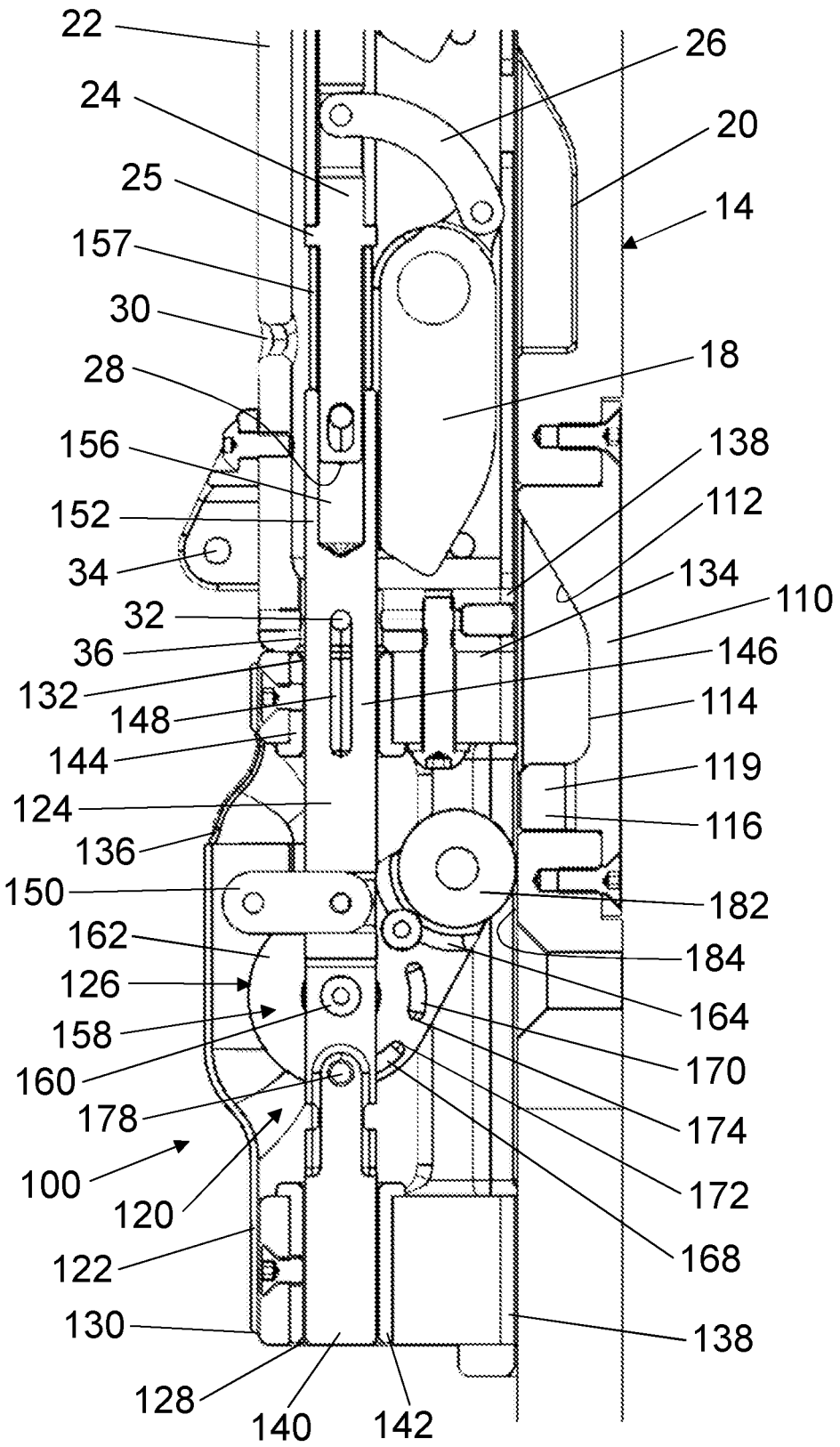
FIG. 2 is a cross-sectional view of the apparatus of FIG. 1A.

The locking mechanism 12 of the car 10 comprises pawls 18 which are arranged to engage with corresponding recessed pockets or seats 20 provided in the track 14. The pawls are pivotally mounted in a housing 22 of the locking mechanism 12. The locking mechanism 12 is switchable between a locked configuration (shown in FIG. 1A), in which the pawls 18 are arranged to engage with the seats 20 to prevent the car 10 from being lowered in the second direction, and an unlocked configuration (shown in FIG. 1B) in which the pawls 18 are disengaged from the seats 20 so that the car 10 may be moved in the second direction to lower the sail. As can be seen in FIGS. 1 and 2, the locking mechanism 12 comprises a control member in the form of an actuating rod 24. Each pawl 18 is connected to the rod 24 by a link 26 such that movement of the rod 24 in the first (upward) direction relative to the pawls 18 causes the pawls 18 to pivot into the locked configuration, and movement of the rod 24 in the second (downward) direction relative to the pawls 18 retracts the pawls 18 into the unlocked configuration. The locking mechanism 12 is biased into the unlocked configuration by a compression spring (not shown) provided on the rod 24.

Referring additionally to FIG. 2, the locking mechanism 12 may be operated manually by a trip line (not shown) connected to the rod 24 adjacent a lower end 28 of the rod 24. The trip line is arranged to extend through an aperture 30 in the housing 22 above the lower end 28 of the rod 24 such that pulling the trip line causes the rod 24 to move in the first direction. Adjacent a lower end of the housing 22 of the locking mechanism 12, an opening 36 is provided, aligned with the lower end 28 of the rod 24.

The apparatus of the present invention is arranged to actuate the locking mechanism 12 of the car 10 automatically as the car 10 is hoisted and lowered on the mast.

As seen most clearly in FIG. 2, the apparatus 100 comprises a track insert 110 and an actuator assembly 120.

The apparatus comprises a housing 122 that houses the actuator assembly 120 comprising an actuator in the form of an elongate shaft 124 and a latch assembly 126.

The housing 122 comprises a generally hollow body having a first opening 128 disposed adjacent a first, lower end 130 of the housing 122 and a second opening 132 disposed adjacent a second, upper end 134 of the housing. A trip line aperture 136 is provided in the housing 122 adjacent the second opening 132. The trip line aperture 136 opens upwardly and away from the track 14 in use.

The housing 122 is arranged to move up and down on the track 14 and is provided with mounting portions or sliders 138 for engagement with the track 14. Each of the mounting portions 138 extends from the housing 122 towards the track 14 and comprises a T-shaped channel (not shown) for engagement with the T-track 14. In this way, the mounting portions 138 retain the housing 122 on the track 14 such that the housing 122 and the actuator assembly 120 may move up and down along the track 14.

In use, the actuator assembly 120 moves up and down the mast (along the track) with the car 10. To this end, the housing 122 is mounted, with suitable fasteners, to a lower end of the car 10, such that the second opening 132 is aligned with the opening 36 adjacent the lower end of the car 10.

The shaft 124 extends through the housing 122 between the first opening 128 and the second opening 132, with a lower end 140 of the shaft 124 disposed in the first opening 128 and the shaft 124 extending upwardly through the second opening 132. The shaft 124 is slidably engaged with tubular bearing sleeves 142, 144 provided in the first and second openings 128, 132 so that the shaft 124 is guided to slide with respect to the housing 122 in a linear direction, substantially parallel to the track 14. An upper portion 146 of the shaft 124 extends through the opening 36 in the car housing 22, towards the rod 24. An elongate retaining slot 148 extends through the upper portion 146 and is arranged to receive a retaining pin 32 provided in the opening 36. A trip line arm 150 provided on the shaft 124 projects from the shaft 124 in a direction away from the track 14 in use. The trip line arm 150 is disposed adjacent the trip line aperture 136 and provides a connection point for a trip line (not shown) for manual control.

A tubular engagement portion 152 is provided by a hollow portion of the shaft 124 at an upper end 154 of the shaft 124. The engagement portion 152 is arranged to engage with part of the rod 24, to couple the actuator assembly 120 to the locking mechanism 12 of the car 10. In use, a lower end 28 of the rod 24 is received in a bore 156 of the engagement portion 152. A compression spring 157 is provided on the rod 24 between the engagement portion 152 and an annular flange 25 on the rod 24.

Figure 3:
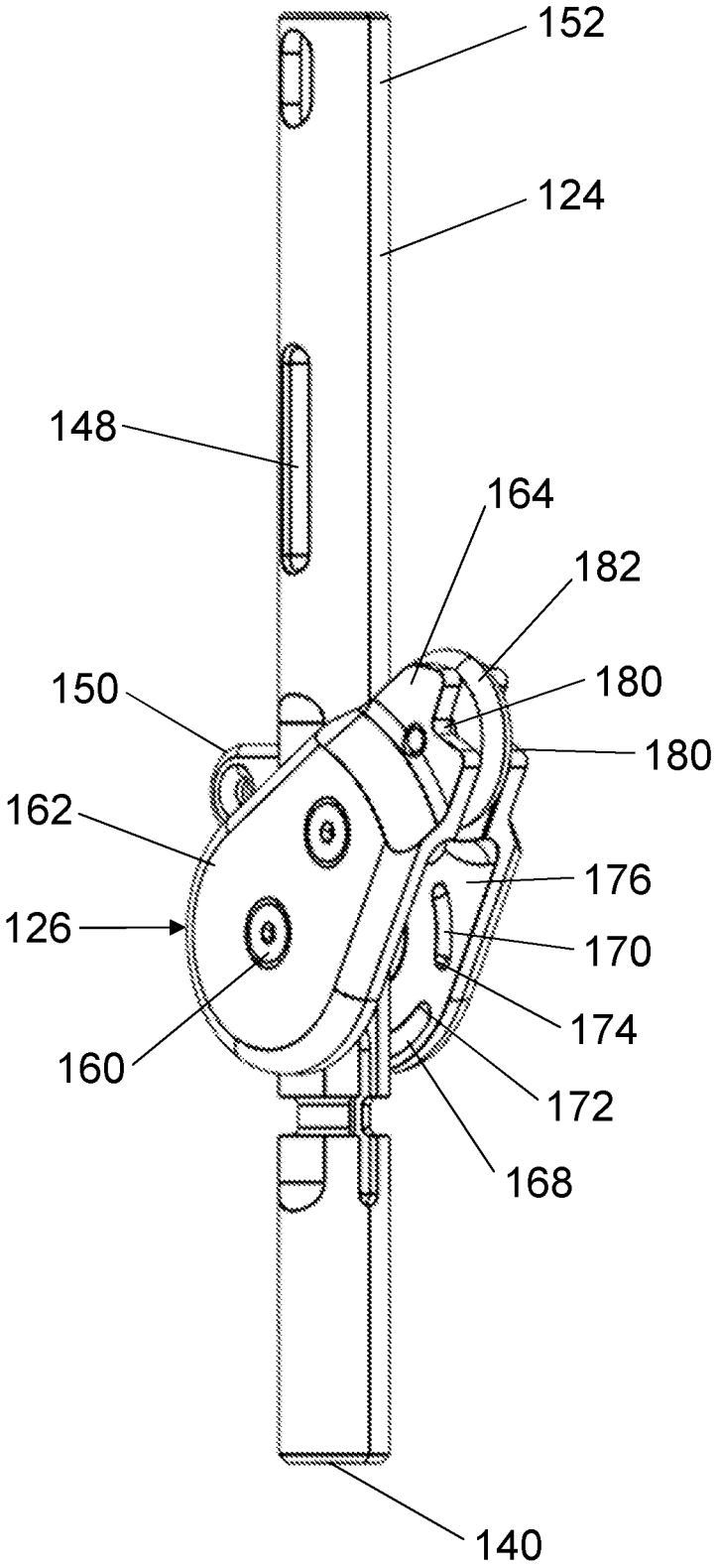
FIG. 3 is a perspective view of part of the apparatus of FIG. 1A.
Figure 4A:
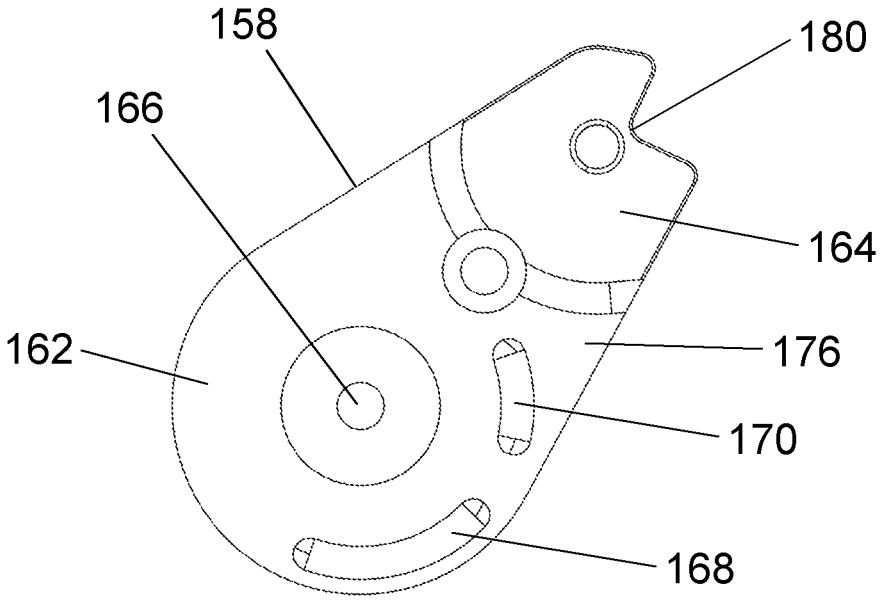
FIG. 4A is a side view of part of the apparatus of FIG. 1A.
Figure 4B:
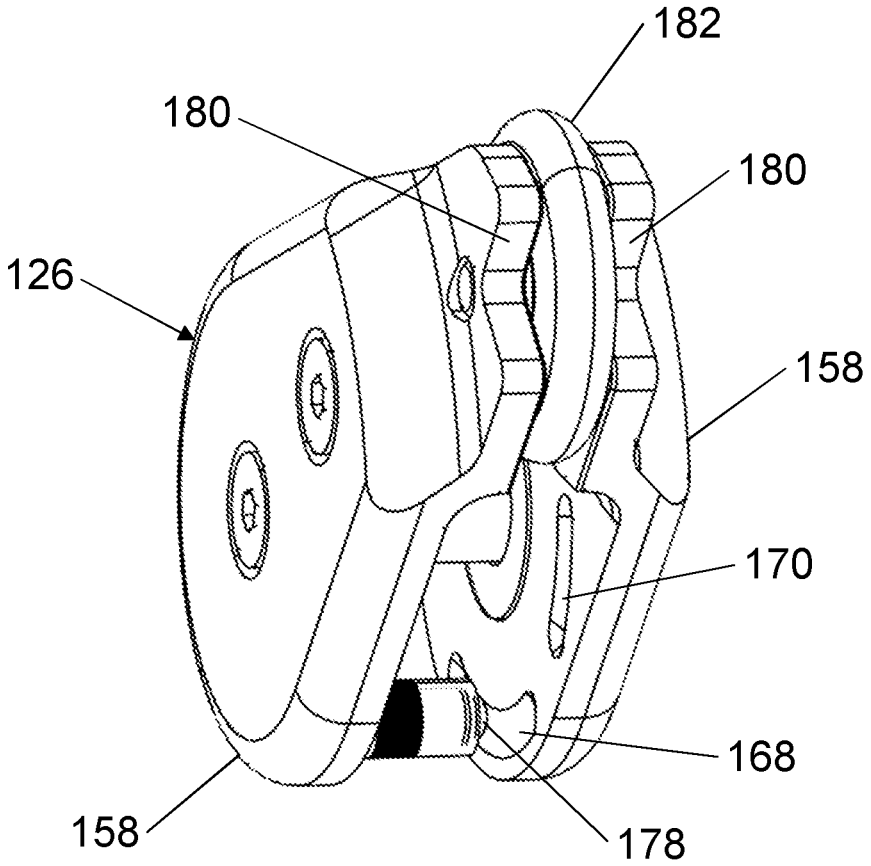
FIG. 4B is a perspective view of part of the apparatus of FIG. 1A.

Referring additionally to FIGS. 3, 4A and 4B, the latch assembly 126 comprises a pair of cam shaped latch elements 158. The latch elements 158 are spaced apart from one another and are mounted on opposite sides of the shaft 124. The latch elements 158 are mounted on a pivot pin 160 which extends through a bore in the shaft 124. In this way, the latch assembly 126 is pivotally mounted on the shaft 124.

Each latch element 158 comprises a pivot portion 162 and a latch portion 164. As can be seen in FIG. 4A, the pivot portion 162 comprises a bore 166 for receiving part of the pivot pin 160, a first detent track 168 and a second detent track 170. The first and second detent tracks 168, 170 are spaced radially from the bore 166 and comprise arcuate grooves which extend part way around the bore 166. The detent tracks 168, 170 therefore extend along a common arc centred on the pivot point of the latch element 158. An inner end 172 of the first detent track 168 is disposed adjacent to, and spaced apart from, an inner end 174 of the second detent track 170 (see FIG. 3). In this way, the first and second detent tracks 168, 170 form a discontinuous arcuate track which is interrupted by a non-grooved surface or land of the pivot portion between the first and second detent tracks 168, 170. The ends of the first and second detent tracks 168, 170 are ramped.

The detent tracks 168, 170 are disposed on an inner side 176 of the latch element 158. In this way, the first and second detent tracks 168, 170 on one of the latch elements 158 face towards, and are aligned with, the first and second detent tracks 168, 170 on the other of the latch elements 158.

A pair of ball plungers 178, in this case provided by a double-ended ball plunger mounted in a transverse bore in the shaft 124, is disposed between the latch elements 158, as can be seen in FIG. 4B. The ball plungers 178 provide followers that cooperate with the detent tracks 168, 170 in the respective latch elements 158, to releasably retain the latch assembly 126 in different pivoted positions with respect to the shaft 124, as described further below.

The latch portion 164 of each latch element 158 is offset inwardly from its respective pivot portion 162. In this way, the spacing between the latch portions 164 of the two latch elements 158 is less than the spacing between the pivot portions 162. Each latch portion 164 comprises a notch 180 which opens away from the pivot portion 162, generally towards the track 14 in use. The notches 180 are arranged to engage with the track insert 110, as described further below.

A rider in the form of a wheel 182 is disposed between the latch portions 164. The wheel 182 is mounted for rotation on a pin which extends between the latch portions 164. The radius of the wheel 182 is sized to extend beyond the notches 180 towards the track 14 in use. The wheel 182 is arranged to ride along the track 14 and to follow the shape of the track insert 110.

Figure 5:
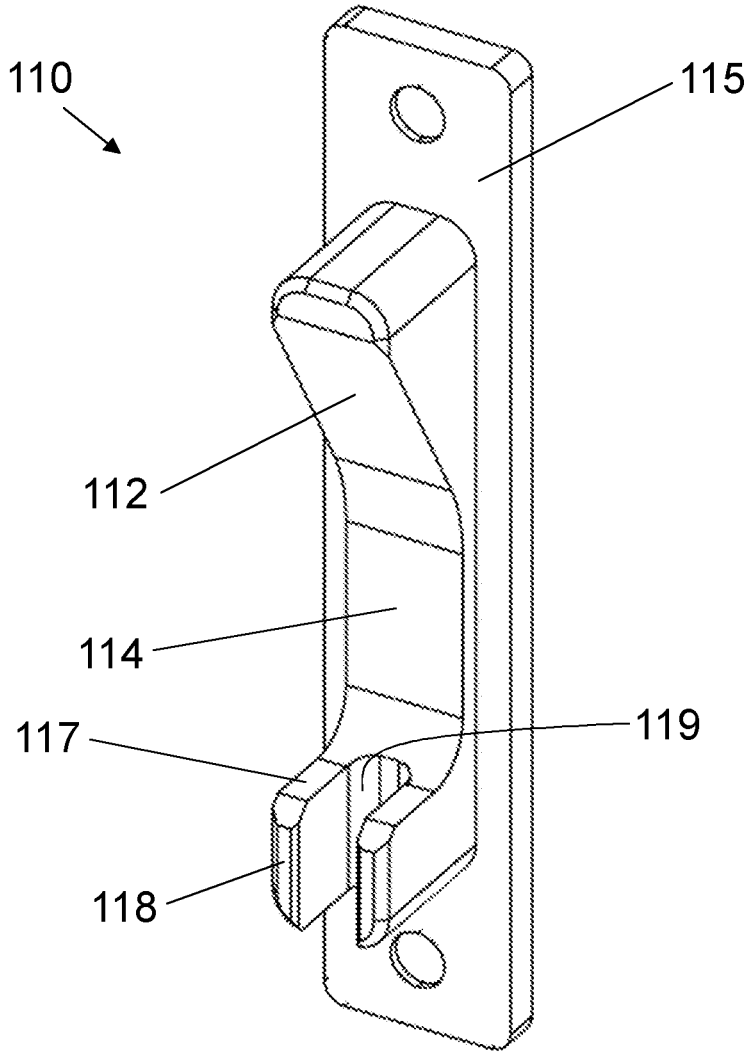
FIG. 5 is a perspective view of part of the apparatus of FIG. 1A.

Referring back to FIG. 2, and additionally to FIG. 5, the track insert 110 comprises a ramped control surface 112, a recessed portion 114, and a latch formation 116. In use, the control surface 112 faces downwardly and outwardly (away from the mast). The latch formation 116 is disposed below the control surface 112 and is spaced apart from the control surface 112 by the recessed portion 114. The latch formation 116 is in the form of a step having an upper surface or seat 117 and an outer surface 118. The latch formation 116 also includes a central cut-out or slot 119 that extends into the upper and outer surfaces 117, 118 of the latch formation 116. The slot 119 is arranged to receive part of the wheel 182. The latch formation is arranged to engage with the notches 180 of the latch elements 158 as will be described in more detail below.

The track insert 110 also comprises a mounting plate 115 for securing the insert 110 to the track 14. In use, the track insert 110 is mounted in an inline arrangement with the track 14.

FIG. 2 shows the apparatus in a first, disengaged configuration, for example prior to hoisting a sail, with the car locking mechanism 12 in the unlocked configuration.

In this disengaged configuration, the latch assembly 126 is pivoted upwardly such that the latch portions 164 are disposed above the pivot portions 162. In the configuration of FIG. 2, the latch elements 158 may be described as being in a leading position, with respect to the upward, hoisting direction. The wheel 182 rests against and rides along an outer surface 184 of the track 14. In this arrangement, the ball plungers 178 are engaged in the first detent tracks 168, at a position away from the inner ends 172 of the first detent tracks 168.

Figure 6:
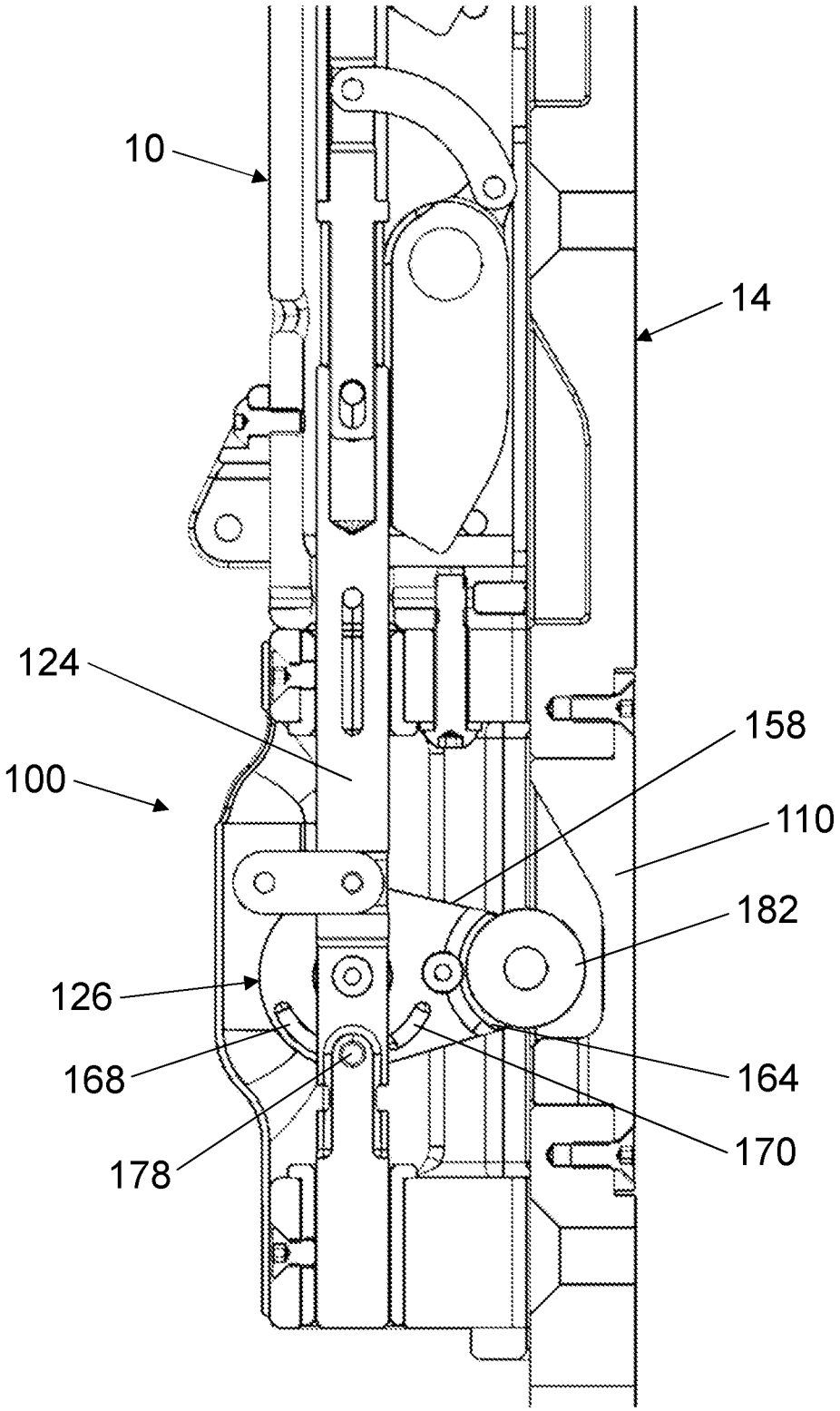
FIGS. 6 to 10 are cross-sectional views showing steps of operation of the apparatus of FIG. 1A.

Referring now to FIG. 6, as the car 10 is hoisted upwardly along the track 14, the wheel 182 reaches the track insert 110 and the latch assembly 126 pivots downwards (clockwise in the Figures) due to gravity such that the latch portions 164 and the wheel 182 drop to extend into the recess provided by the track insert 110. As the latch assembly 126 pivots downwardly, the ball plungers 178 travel in the first detent tracks 168 until they reach the inner ends 172 (not visible in FIG. 6) of the first detent tracks 168. The force applied by the ball plungers 178 is sufficient to prevent the ball plungers 178 from disengaging from the first detent tracks 168, thereby limiting further downward pivoting of the latch assembly 126. In this configuration, the latch elements 158 are held in a first detent position, in which the latch elements 158 are not engaged with the track 14.

Due to the orientation of the notches 180, when the latch elements 158 are in this first detent position, subsequent downward movement of the car (e.g. lowering the sail) does not cause the latch elements 158 to engage with the track 14, but rather returns the latch assembly 126 to the disengaged configuration shown in FIG. 2.

Figure 7:
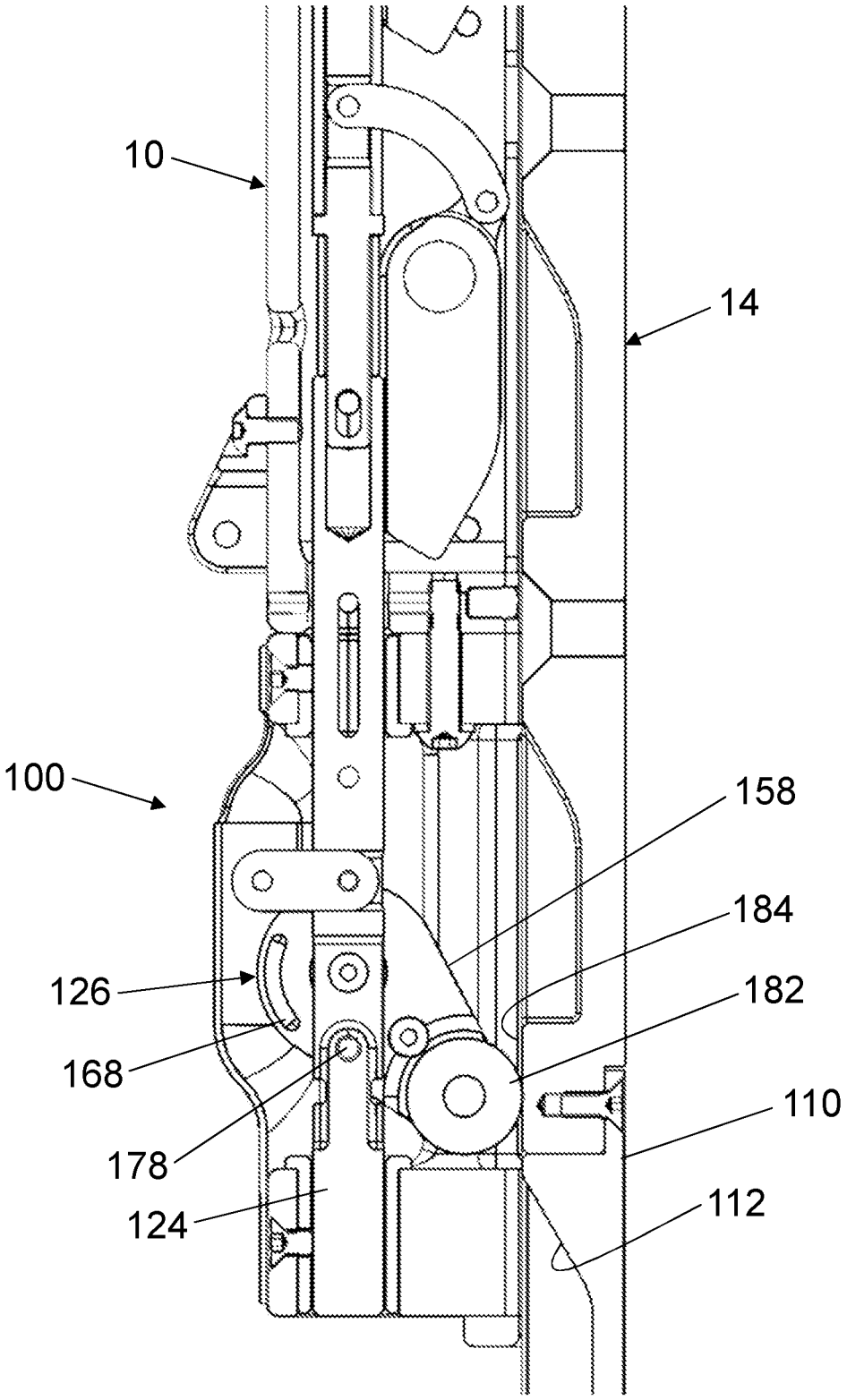

With reference to FIG. 7, as the car 10 is hoisted further upwards (e.g. as the sail is hoisted), the wheel 182 contacts and rides along the control surface 112, which urges the latch assembly 126 to pivot further downwardly (i.e. clockwise in the figures) and away from the track 14. The turning force thus applied to the latch assembly 126 overcomes the retaining force applied by the ball plungers 178, such that the ball plungers 178 escape the first detent tracks 168 and engage with the second detent tracks 170. Further downward pivoting of the latch assembly 126 under gravity is limited by a torsion spring (not shown) which biases the latch assembly 126 upwardly towards the first detent position. The wheel 182 is biased against the outer surface 184 of the track 14 above the insert 110. In this arrangement, the latch elements 158 are now in a trailing position (e.g. with respect to a hoisting direction).

Figure 8:
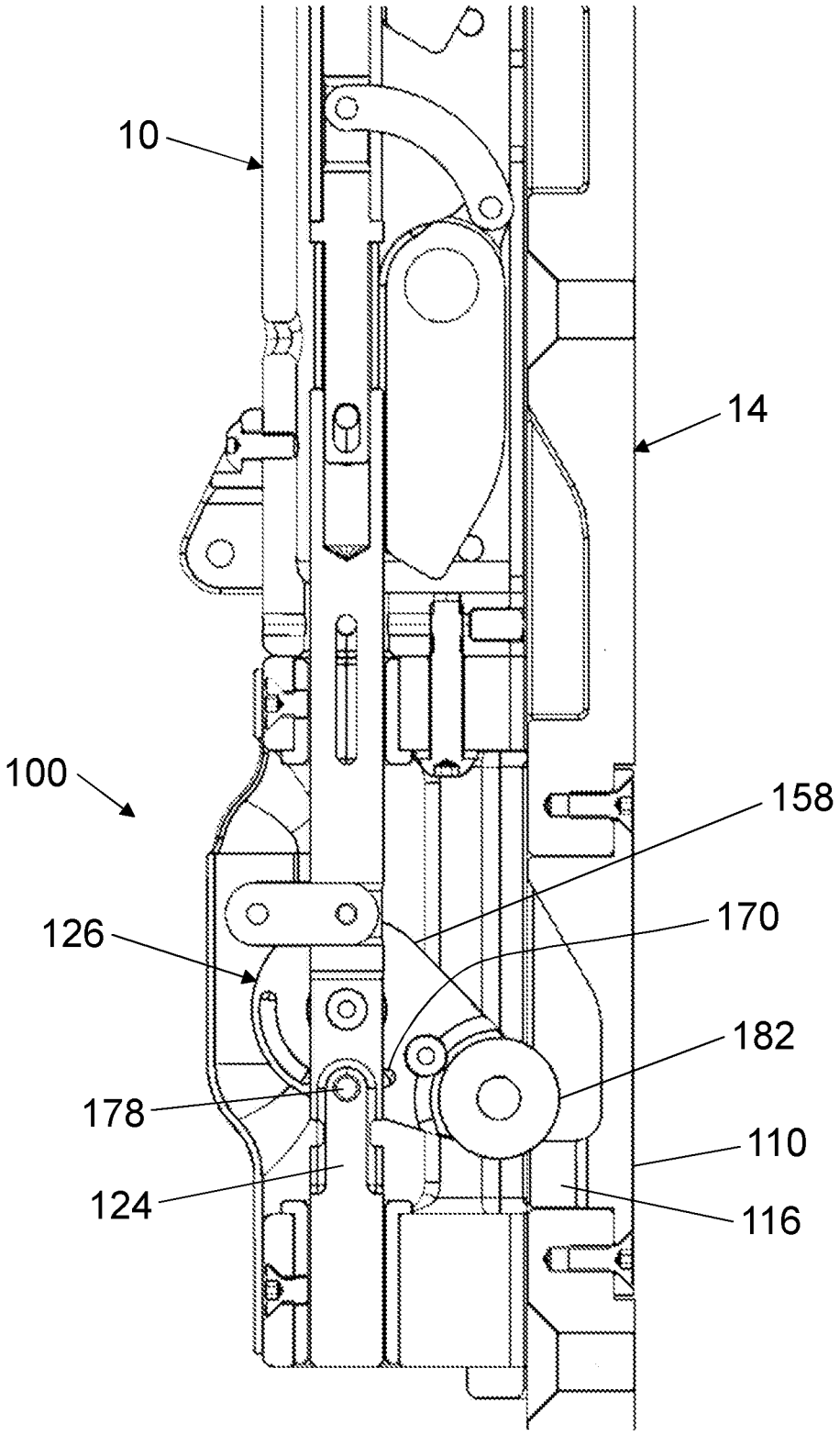

Subsequent downward movement of the car 10 moves the shaft 124 and the latch assembly 126 back towards the track insert 110. As the latch assembly 126 reaches the insert, the latch assembly 126 begins to pivot upwardly under the biasing action of the torsion spring. However, pivoting of the latch assembly 126 is limited by the ball plungers 178 as they reach the inner ends 174 of the second detent tracks 170. In this way, the latch elements 158 are retained in a second detent position, as shown in FIG. 8.

Figure 9:
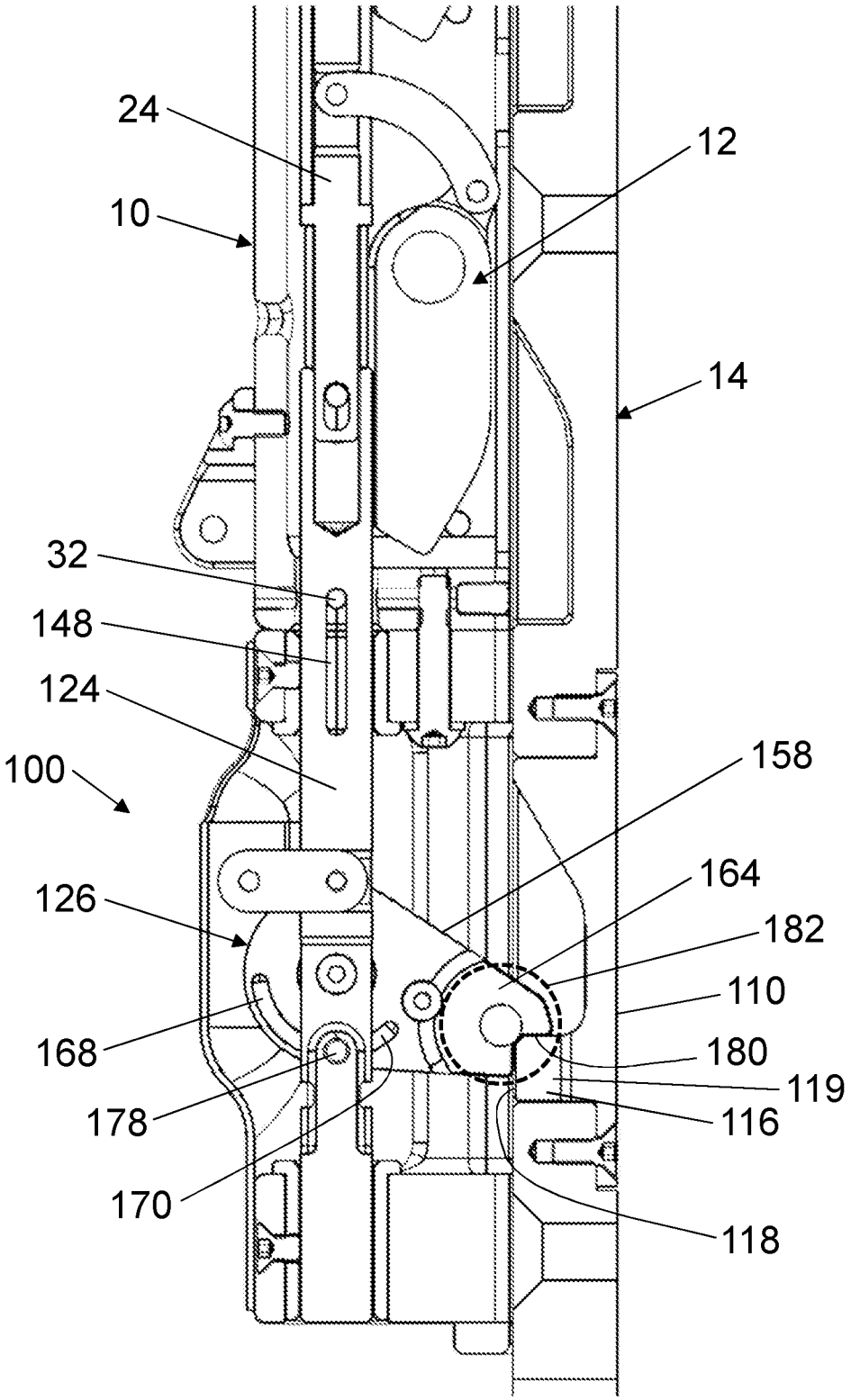

From this position, further lowering of the car 10 moves the latch portions 164 towards the latch formation 116. As shown in FIG. 9, part of the wheel 182 is received in the slot 119 to allow the notch 180 of each latch element 158, now suitably oriented, to engage with the latch formation 116. In FIG. 9, to show better the engagement of the notches 180 with the latch formation 116, only an outline of the wheel 182 is shown, represented by a dashed line.

As the latch elements 158 are brought into engagement with the latch formation 116, the latch assembly 126 is pivoted slightly upwards (i.e. rotated counterclockwise), such that the ball plunger 178 is urged out from the inner ends 174 of the second detent tracks 170 and rests between the inner ends 172, 174 of the first and second detent tracks 168, 170.

Figure 10:
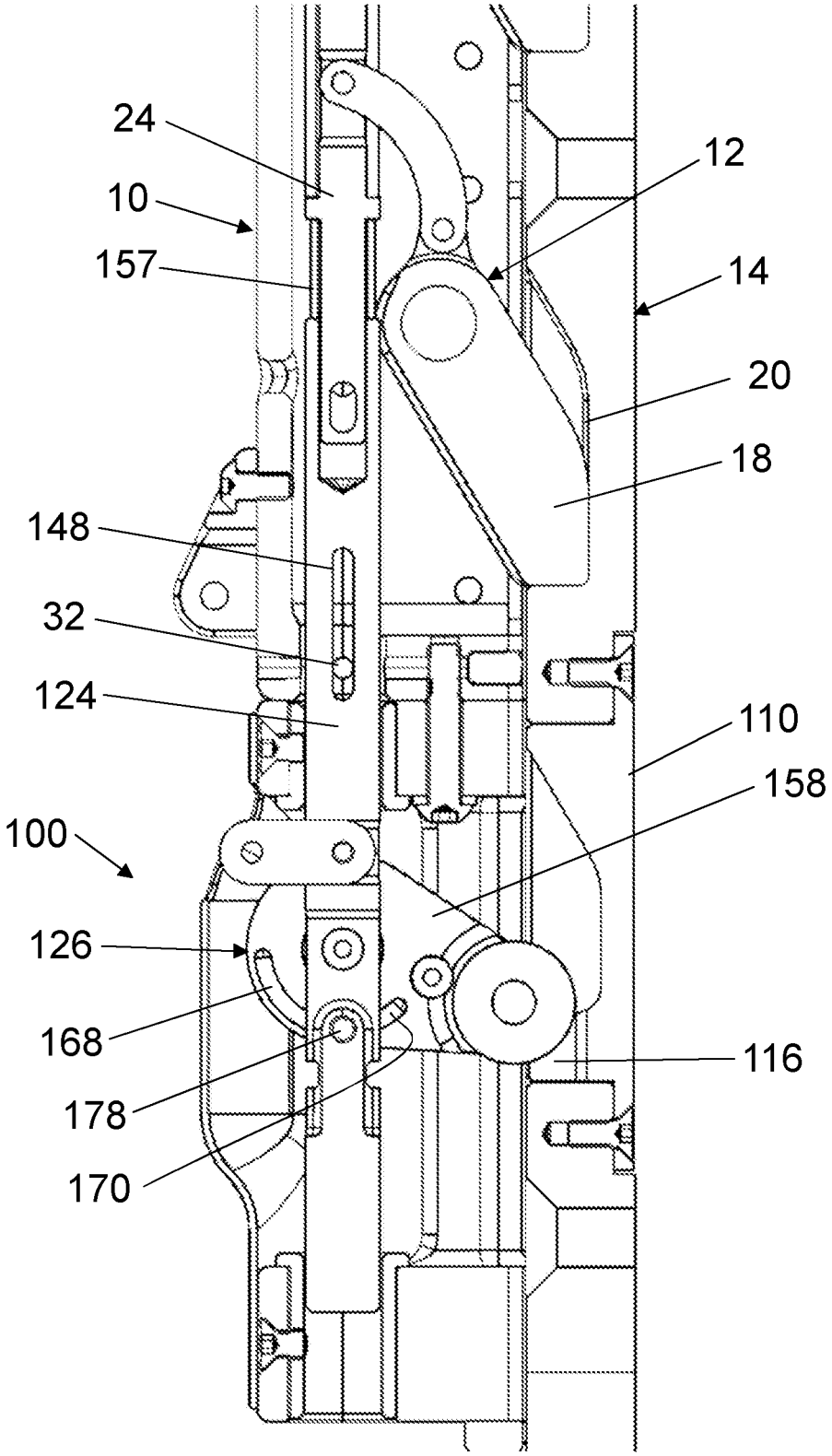

In this engaged configuration, shown in FIG. 9, further pivoting of the latch assembly 126 upwardly towards the first detent position is prevented by abutment of the notches 180 with the outer surface 118 of the latch formation 116. In this way, downward movement of the shaft 124 with respect to the track 14 is blocked. Accordingly, further lowering of the car 10 pushes the shaft 124 relatively towards the car locking mechanism 12, thereby moving the rod 24 to switch the locking mechanism 12 into the locked configuration, as can be seen in FIG. 10.

As the shaft 124 pushes the rod 24 to actuate the locking mechanism 12, the compression spring 157 disposed between the shaft 124 and the rod 24 is compressed. In this way, downward force is applied on the shaft 124 to keep the latch elements 158 engaged with the latch formation 116, whilst allowing the car 10 to be hoisted high enough to provide clearance for the pawls 18 to swing into the seats 20. Additionally, once the pawls 18 are engaged with the track 14 to carry a load (e.g. sail tension) acting downwardly on the car 10, the shaft 124 and latch assembly 126 are subject only to the force exerted by the spring 157, and do not carry the full load from the car 10. Advantageously, since components of the apparatus 100 are subject only to forces sufficient to actuate the locking mechanism 12, and are not subject to a working load (e.g. sail load) on the car 10, these components need not be bulky and/or may be manufactured from lighter materials, allowing the apparatus 100 to be relatively compact and lightweight.

To unlock the car 10, the car 10 is hoisted upwards, which moves the locking mechanism 12 upwardly away from the shaft 124. In this way, the rod 24 is freed to move downwardly with respect to the pawls 18, so as to release the pawls 18 to return to the unlocked configuration.

As the car 10 is hoisted, the shaft 124 is pulled upwardly by abutment of the retaining pin 32 with an upper end of the retaining slot 148. In this way, the latch assembly 126 is moved upwardly away from the latch formation 116, allowing the latch assembly 126 to pivot under the action of the torsion spring so as to return the latch elements 158 to the first detent position. In this first detent position, the notches 180 are oriented to pass over the step of the latch formation 116 instead of engaging with it, so subsequent lowering of the car (e.g. to lower the sail) returns the latch elements 158 to the leading position of FIG. 2, in which the car 10 and actuator assembly 120 may be moved freely in either direction along the track 14.

The apparatus 100 of the present invention is arranged to be retrofitted to a manually operable locking car in order to provide a semi-automatic "hoist to lock, hoist to unlock" method of operation. Advantageously, the apparatus 100 is arranged to be fitted to the car 10 without the need for modification or any significant disassembly of the car 10. In use, the housing 122 and actuator assembly 120 may be fitted to the car 10 by sliding the housing 122 along the track 14 and securing (e.g. bolting) the housing 122 to the housing 22 of the car 10. The shaft 124 is inserted into the opening 36 to engage with the rod 24, and secured by the retaining pin 32. In other embodiments, the actuator assembly and car may be integrated, as a single assembly or unit.

The latch assembly 126 may also be released directly, by applying an upwardly acting force to a trip line (not shown) connected to the trip line arm 150 and extending through the trip line aperture 136. The trip line may be fed around a pin 34 above the trip line aperture 136 and down towards a foot of the mast.

It will be appreciated that the wheel 182 serves to ease movement of the latch assembly 126 with respect to the track 14. In addition, the wheel 182 also helps to prevent engagement of the latch elements 158 with the main pawl seats 20 in the track. Unlike the track insert 110, the seats 20 are not provided with a slot, so that the wheel 182 causes the latch assembly 126 to ride over the seats 20 without the latch elements 158 engaging with the seats 20. In this way, the latch elements 158 engage only where a track insert 110 is provided on the mast.

It will also be appreciated that the track insert 110 is spaced from the seats 20 by a distance corresponding to dimensions of the actuator assembly 120 such that the pawls 18 are accurately aligned for engagement with the seats 20 when the latch elements 158 engage with the track insert 110. In this way, the risk of the pawls 18 only partially engaging with the seats 20, or engaging with another feature of the track 14, is greatly reduced.

Advantageously, in the embodiment described above, the track insert 110 which provides the latch formation 116 is arranged in line with the track 14. In this way, the track insert can be installed in an existing track without the need to cut an additional slot in the mast. In other embodiments, for instance where the sail is provided with a bolt rope, the track may not have slots, as these may chafe the sail around the bolt rope. In such embodiments, the latch assembly may be arranged such that the latch elements are disposed on either side of the track, for example by providing track inserts on the mast on either side of the track.

In some embodiments, the car may be arranged to lock at more than one position along the track, such as a full hoist position, and one or more reefing positions, with seats provided in the track for locking at these positions. Accordingly, more than one track insert may be provided along the track such that there may be a corresponding track insert for each locking position of the car, to actuate locking of the car at each position.

In other embodiments, the apparatus may be used to actuate locking mechanisms of other cars, which may be on other tracks on a sailing vessel. For example, the apparatus may be used with a jib or genoa lead car on a track mounted on a deck, or with a traveller. In such applications, the apparatus may be arranged to move generally horizontally along a track, in which case the apparatus may be mounted in an alternative orientation to the orientation described in relation to the first embodiment. In such embodiments, the latch assembly may not move from the leading position to the first detent position due to gravity, but may instead be biased into the first detent position from the leading position, for example by an additional torsion spring acting. The latch assembly may therefore be biased towards the first detent position from both the leading position and the trailing position.

In other applications, the apparatus may be used to cooperate with other tracked devices. It will be appreciated that in other embodiments, the apparatus may be used as a locking device by itself (e.g. without a cooperating locking device such as a car), to support a load with respect to a track. For example, a load could be coupled directly to an end of the actuator (e.g. the shaft 124) and the apparatus could be locked in position on the track, or released to slide along the track, by relative movement of the apparatus with respect to the track, as described above.

Further modifications and variations not explicitly described above may also be contemplated without departing from the scope of the invention as defined in the appended claims.

The invention claimed is:

1. An apparatus for actuating a locking mechanism of a locking sail track car, the car being slidable on a track, and the locking mechanism comprising a control member operable to switch the locking mechanism between an unlocked configuration in which the car is free to slide on the track and a locked configuration in which the locking mechanism engages with the track to block movement of the car in a loading direction;

the apparatus comprising a latch formation disposed in a fixed position with respect to the track, a control surface spaced from the latch formation in a hoisting direction, opposite to the loading direction, and an actuator assembly for attachment to the car;

the actuator assembly comprising an actuator for operating the control member of the car locking mechanism, and a latch element connected to the actuator and moveable between a first detent position in which the latch element is not engageable with the latch formation and a second detent position; wherein:

the latch element is arranged to cooperate with the control surface upon movement of the actuator assembly in the hoisting direction to set the latch element into the second detent position; and the latch element is engageable with the latch formation upon subsequent movement of the actuator assembly in the loading direction with the latch element in the second detent position;

whereby engagement of the latch element with the latch formation fixes the actuator in position with respect to the track for operating the control member of the car locking mechanism upon subsequent movement of the car in the loading direction, and urges the latch element out of the second detent position and towards the first detent position such that subsequent movement of the actuator assembly in the hoisting direction to disengage the latch element from the latch formation sets the latch element into the first detent position.

2. The apparatus according to claim 1, wherein the latch element is mounted to the actuator at a pivot, and wherein said movement between the first detent position and the second detent position comprises turning of the latch element about the pivot.

3. The apparatus according to claim 1, comprising a biasing means to urge the latch element towards the first detent position upon disengagement of the latch element from the latch formation.

4. The apparatus according to claim 3, wherein cooperation of the latch element with the control surface during movement of the actuator assembly in the hoisting direction moves the latch element from the first detent position beyond the second detent position to a trailing position, and upon subsequent movement of the actuator assembly in the loading direction the biasing means urges the latch element from the trailing position into the second detent position.

5. The apparatus according to claim 1, wherein, when the latch element is in the first detent position, the latch element is cooperable with the latch formation to move the latch element into a leading position, the leading position being further from the second detent position than the first detent position.

6. The apparatus according to claim 1, comprising a recess disposed between the control surface and the latch formation for accommodating an end part of the latch element when the latch element is in one of the first detent position and the second detent position.

7. The apparatus according to claim 1, comprising a detent mechanism having a follower arranged to apply a resistance force to the latch element to resist movement between the first detent position and the second detent position until the resistance force is overcome.

8. The apparatus according to claim 7, wherein the detent mechanism comprises first and second detent tracks for engagement with the follower, wherein the first and second detent positions correspond to the position of the latch element when the follower is disposed at adjacent ends of the first and second tracks respectively.

9. The apparatus according to claim 1, wherein the latch element comprises a rider arranged to bear on the control surface when the latch element cooperates with the control surface.

10. The apparatus according to claim 9, wherein the rider is arranged to guard against engagement of the latch element with the track.

11. The apparatus according to claim 10, wherein the latch formation comprises a slot for receiving at least a part of the rider so as to allow the latch element to engage with the latch formation when the latch element is in the second detent position.

12. The apparatus according to claim 1, wherein the latch formation comprises a step and the latch element comprises a notch arranged to engage with the step upon movement of the actuator assembly in the load direction when the latch element is in the second detent position, and to pass over the step upon movement of the actuator assembly in the load direction when the latch element is in the first detent position.

13. The apparatus according to claim 1, comprising a housing for the actuator assembly, the housing being attachable to the car.

14. The apparatus according to claim 1, comprising at least one guide to constrain the actuator for linear movement parallel to the track.

15. The apparatus according to claim 1, wherein the actuator comprises an attachment point for attachment of a manual control line.

16. The apparatus according to claim 1, comprising a track insert including the control surface and the latch formation, the track insert being installable in or adjacent to the track on which the car is slidable.

17. A sail track system, comprising:

a track for attachment to a support structure;

a locking sail track car that is slidable on the track, the car having a locking mechanism comprising a control member operable to switch the locking mechanism between an unlocked configuration in which the car is free to slide on the track and a locked configuration in which the locking mechanism engages with the track to block movement of the car in a loading direction; and an apparatus for actuating the locking mechanism;

the apparatus comprising a latch formation disposed in a fixed position with respect to the track, a control surface spaced from the latch formation in a hoisting direction, opposite to the loading direction, and an actuator assembly for attachment to the car;

the actuator assembly comprising an actuator for operating the control member of the car locking mechanism, and a latch element connected to the actuator and moveable between a first detent position in which the latch element is not engageable with the latch formation and a second detent position; wherein:

the latch element is arranged to cooperate with the control surface upon movement of the actuator assembly in the hoisting direction to set the latch element into the second detent position; and the latch element is engageable with the latch formation upon subsequent movement of the actuator assembly in the loading direction with the latch element in the second detent position;

whereby engagement of the latch element with the latch formation fixes the actuator in position with respect to the track for operating the control member of the car locking mechanism upon subsequent movement of the car in the loading direction, and urges the latch element out of the second detent position and towards the first detent position such that subsequent movement of the actuator assembly in the hoisting direction to disengage the latch element from the latch formation sets the latch element into the first detent position.

18. The sail track system according to claim 17, wherein the latch formation and the control surface are disposed in line with the track and the actuator assembly is attached to the car with the actuator arranged to operate the control member of the locking mechanism.

19. The sail track system according to claim 18, wherein the track comprises at least one of the latch formation and the control surface.

20. The sail track system according to claim 17, comprising a compression spring disposed between the actuator and the control member.

* * * * *